US010651576B2

(12) United States Patent
Chen

(10) Patent No.: US 10,651,576 B2
(45) Date of Patent: May 12, 2020

(54) EDGE CARD MOUNTING STRUCTURE

(71) Applicant: ACES ELECTRONICS CO., LTD., Taoyuan (TW)

(72) Inventor: Po-Tsang Chen, Taoyuan (TW)

(73) Assignee: ACES ELECTRONICS CO., LTD., Taoyuan (TW)

( * ) Notice: Subject to any disclaimer, the term of this patent is extended or adjusted under 35 U.S.C. 154(b) by 0 days.

(21) Appl. No.: 16/427,991

(22) Filed: May 31, 2019

(65) Prior Publication Data

US 2019/0372252 A1 Dec. 5, 2019

(30) Foreign Application Priority Data

Jun. 1, 2018 (TW) ..... 107207349 A

(51) Int. Cl.
*H01R 12/70* (2011.01)
*H01R 12/73* (2011.01)

(52) U.S. Cl.
CPC ..... *H01R 12/7029* (2013.01); *H01R 12/737* (2013.01)

(58) Field of Classification Search
CPC ..... H01R 12/7029; H01R 12/737
USPC ..... 439/62, 629, 630, 326, 327, 329, 345
See application file for complete search history.

(56) References Cited

U.S. PATENT DOCUMENTS 5,162,979 A * 11/1992 Anzelone ..... G06F 13/409 361/679.32
5,216,578 A * 6/1993 Zenitani ..... H05K 7/1435 211/41.17
5,419,712 A * 5/1995 Bellomo ..... H01R 12/7023 439/327
5,423,691 A * 6/1995 Pickles ..... H01R 12/7023 439/327
6,056,579 A * 5/2000 Richards, III ..... H05K 7/1454 439/327
6,164,990 A * 12/2000 Yu ..... H05K 7/1405 439/135
6,176,727 B1 * 1/2001 Liu ..... H01R 12/7005 439/327
6,305,964 B1 * 10/2001 Pon ..... H05K 7/1431 439/327
6,319,037 B1 * 11/2001 Lai ..... H01R 12/7005 361/801
6,545,877 B1 * 4/2003 Agha ..... H05K 7/1417 361/759
7,371,097 B1 * 5/2008 Pennypacker ..... H01R 13/6275 439/327

(Continued)

*Primary Examiner* — Harshad C Patel

(74) *Attorney, Agent, or Firm* — Muncy, Geissler, Olds & Lowe, P.C.

(57) ABSTRACT

An edge card mounting structure includes an edge card, an electrical connector disposed on a circuit board, and a rack that holds the edge card and is inserted into the electrical connector to electrically connect the edge card to the electrical connector. The rack includes a rack body that accommodates the edge card, two bearing plates bilaterally disposed in the rack body, and two adjustment members that are elastically pressable to move the accommodated edge card downwardly into abutment against the bearing plates where the electric contacts of the edge card are kept in contact with the respective contact endpieces of the conducting terminal set of the electrical connector for transmitting high frequency signals.

6 Claims, 4 Drawing Sheets

(56) References Cited

U.S. PATENT DOCUMENTS 8,550,836 B2 * 10/2013 Ma ..... G06F 1/185
439/328
8,559,187 B2 * 10/2013 Peng ..... H05K 7/1431
361/798

* cited by examiner

EDGE CARD MOUNTING STRUCTURE

This application claims the priority benefit of Taiwan patent application number 107207349, filed on Jun. 1, 2018.

BACKGROUND OF THE INVENTION

1. Field of the Invention

The present invention relates to edge card mounting structure technology, and more particularly to an edge card mounting structure, which comprises an edge card, an electrical connector disposed on a circuit board, and a rack that holds the edge card and is inserted into the electrical connector to electrically connect the edge card to the electrical connector, wherein the rack comprises a rack body that accommodates the edge card, two bearing plates bilaterally disposed in the rack body, and two adjustment members that are elastically pressable to move the accommodated edge card downward into abutment against the bearing plates where the electric contacts of the edge card are kept in positive contact with the conducting terminal set of the electrical connector for transmitting high frequency signals stably.

2. Description of the Related Art

Today's computer technology is rapidly evolving with each passing day, and desktop or notebook computers are ubiquitous in every corner of the society. The development trend of the computer is also moving toward a powerful computing function, a fast speed and a small size, so that the connector inside the computer is also greatly reduced, so as to cope with the development trend of today's computers. In addition, in order to cope with the continuous improvement and advancement of computer operation functions, the motherboard of the computer must expand the memory card, interface card or function board to upgrade the overall application function, operation efficiency and operation capability. However, in order to expand the memory card, interface card or function board on the motherboard, the motherboard should also be provided with relative connectors for various types of memory cards, interface cards or function boards for the transmission of electronic signals.

However, at present, the connector of the motherboard is provided with a locking device. When the expansion memory card, interface card or function board is docked on the connector, it can be fixed by the locking device. However, due to the vibration of the industrial computer, the on-board computer or other types of computers during operation, the locking device is prone to loosening, so that the memory card, interface card or function card is easy to loosen from and jump out of the locking device, resulting in a failure to form a good electrical connection with the connector.

The general edge card connector needs to reduce the height to meet the process limit, and also meet the minimum use area requirements, so a split-type design is proposed. In the slit-type design, the connector is installed using surface mount technology (SMT), then the edge card rack that has the edge card loaded therein is inserted into the connector. According to the prior art design, the edge card rack has two screw holes respectively located on the two opposite ends of the bottom side thereof. After the edge card is loaded in the edge card rack, the electric contacts of the edge card are exposed to the outside of the rack. In installation, the edge card rack is attached to the circuit board to force the edge card into the connector at the circuit board, and then screws are respectively threaded into the screw holes of the edge card rack to affix the edge card rack to the circuit board. However, the disadvantage of applying the aforesaid mounting procedure is that the edge card assembler must use a tool (screwdriver) to fasten the screws, which is very time-consuming and inefficient to assemble manually. People involving in this industry need to improve the assembly process.

Therefore, how to solve the above-mentioned problem is the direction that the relevant industry is eager to study and improve.

SUMMARY OF THE INVENTION

The present invention has been accomplished under the circumstances in view. It is therefore the main object of the present invention to provide an edge card mounting structure, which comprises an edge card, an electrical connector disposed on a circuit board, and a rack that holds the edge card and is inserted into the electrical connector to electrically connect the edge card to the electrical connector. The rack comprises a rack body that accommodates the edge card, two bearing plates bilaterally disposed in the rack body, and two adjustment members disposed above the rack body and elastically pressable to move the accommodated edge card downwardly into abutment against the bearing plates where the electric contacts of the edge card are kept in contact with the respective contact endpieces of the conducting terminal set of the electrical connector for transmitting high frequency signals stably.

It is another object of the present invention to provide an edge card mounting structure, which allows the edge card to be mounted in the rack without using any hand tools, and also allows the rack to be mounted in the electrical connector to electrically connect the accommodated edge card to the electrical connector without using any hand tools, wherein the rack has two retaining spring plates respectively disposed at two opposite lateral sides thereof for securing to respective upright posts of the electrical connector to prevent separation between the rack and the electrical connector upon vibration. Subject to the engagement structure between the rack and the electrical connector, the edge card can be positively connected to the electrical connector without using any hand tools.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
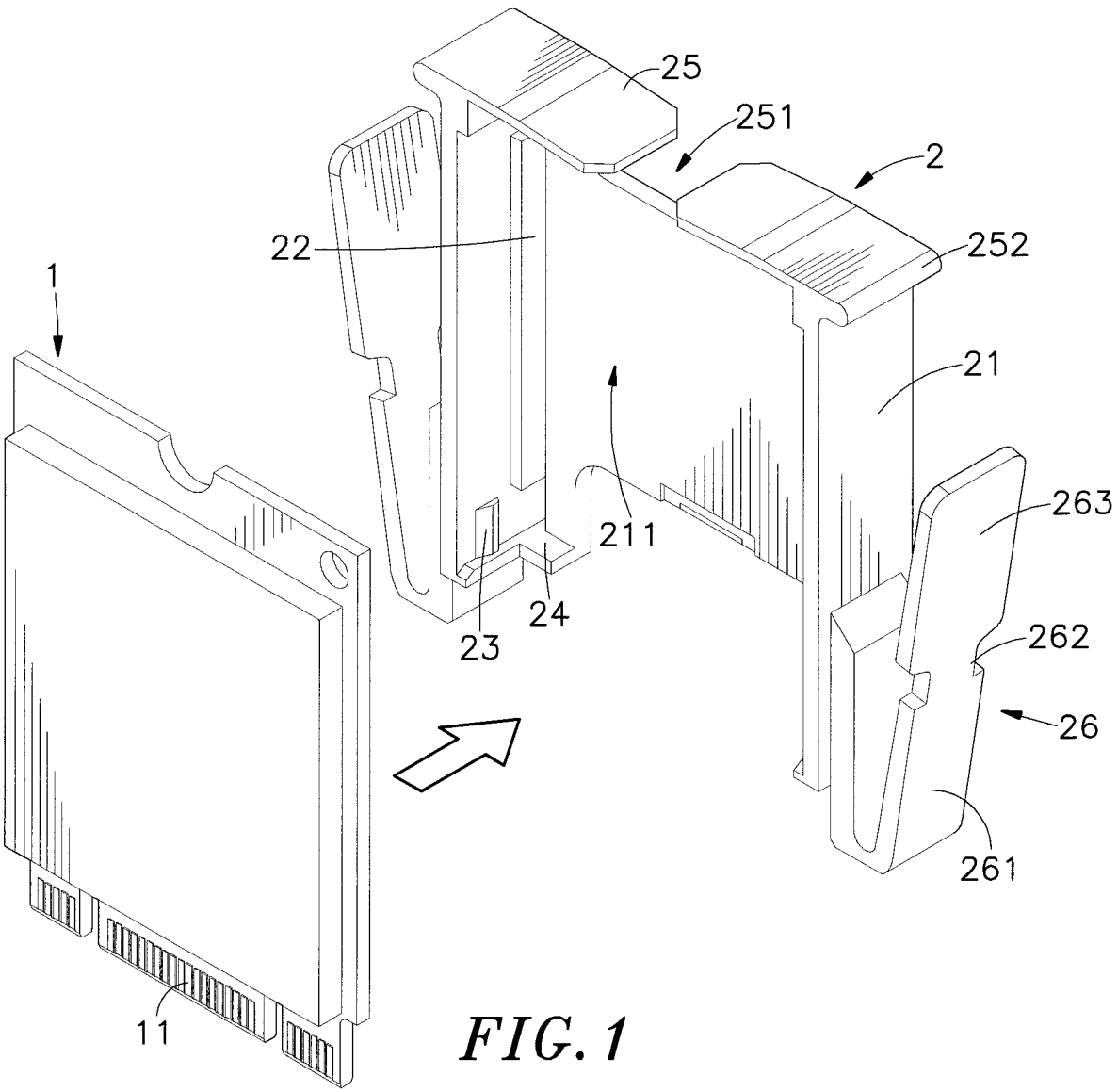
FIG. 1 is an exploded view of a part of an edge card mounting structure in accordance with the present invention, illustrating the relationship between an edge card and a rack.
Figure 2:
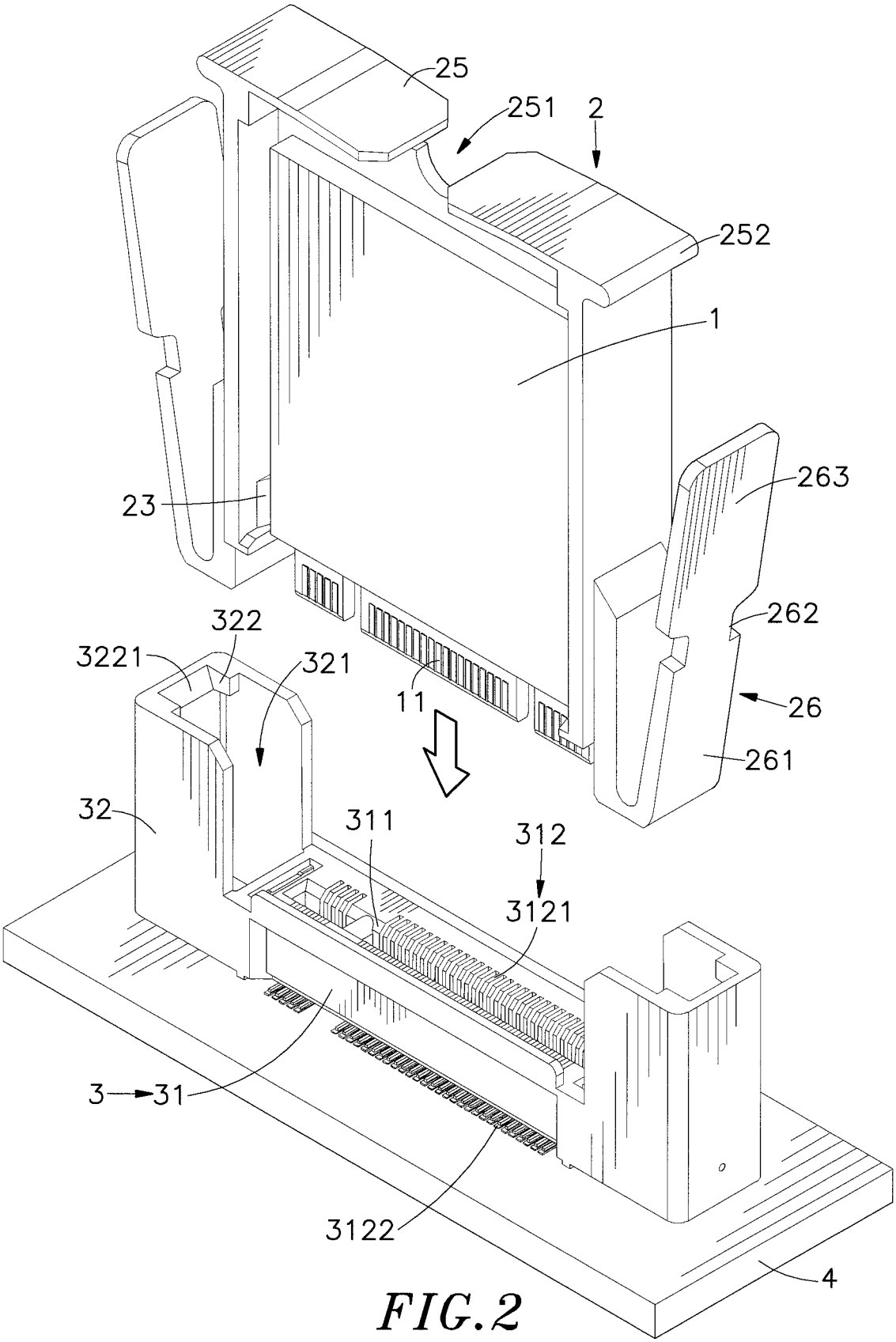
FIG. 2 is an exploded view of the edge card mounting structure in accordance with the present invention, illustrating the edge card mounted in the rack before installation of the rack in the electrical connector.
Figure 3:
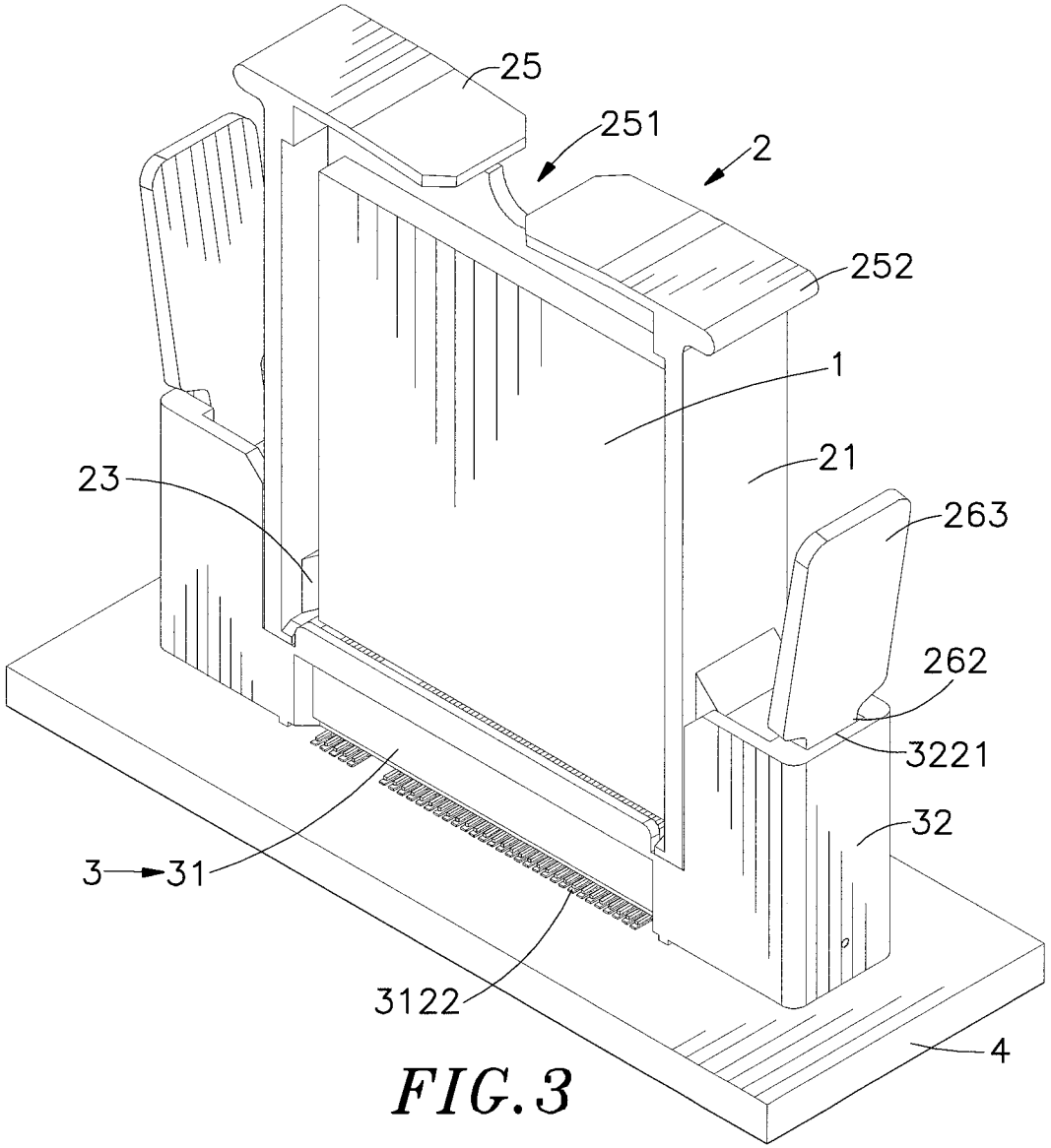
FIG. 3 is an oblique top elevational view of the present invention, illustrating the rack installed in the electrical connector.

Referring to FIGS. 1-4, an edge card mounting structure in accordance with the present invention is shown. As illustrated, the edge card mounting structure comprises an edge card 1, a rack 2 and an electrical connector 3 mounted on a circuit board 4.

The edge card 1 is mounted in the rack 2. The rack 2 is fastened to the electrical connector 3.

The rack 2 comprises a rack body 21, two stop plates 22, two position-limiting blocks 23, two bearing plates 24, and at least one adjustment member 25.

The rack body 21 defines in one side thereof an accommodation open chamber 211 for accommodating the edge card 1.

The two stop plates 22 are bilaterally and fixedly mounted in the accommodation open chamber 211 for abutment against one surface of the edge card 1.

The two position-limiting blocks 23 are bilaterally and fixedly mounted in the accommodation open chamber 211 for abutment against the opposite surface of the edge card 1. The area formed between the two position-limiting blocks 23 and the two stop plates 22 sandwiches the two opposite surfaces of the edge card 1. The position-limiting blocks 23 are formed by a triangular cylinder. Of course, the structure of the position-limiting blocks 23 is not limited to the triangular cylinder. Any geometric structure capable of limiting the edge card 1 to the rack 2 can be included in the scope of the present invention.

The two bearing plates 24 are bilaterally and fixedly mounted in the accommodation open chamber 211 for abutment against two opposite ends of a bottom side of the edge card 1.

The at least one adjustment member 25 is disposed at a top side of the rack body 21. By pressing the adjustment member 25, the opposite top side of the edge card 1 is moved downward by the pressure so that the two opposite ends of the bottom side of the edge card 1 simultaneously abut against the two bearing plates 24. Each adjustment member 25 is composed of a spring plate. The preferred structure of the at least one adjustment member 25 is two, symmetrically disposed above the rack body 21. Between the adjustment members 25 and the rack body 21, there is an adjustment gap 251, and the adjustment gap 251 is used to provide an elastic space for the displacement of the two adjustment members 25 under pressure.

The electrical connector 3 comprises a base 31, an insertion slot 311 disposed in the base 31 for the insertion of the edge card 1, and a conducting terminal set 312 mounted in the insertion slot 311. The conducting terminal set 312 comprises a plurality of contact endpieces 3121 suspending in the insertion slot 311 for contacting respective electric contacts of the edge card 1 electrically, and a plurality of bonding endpieces 3122 respectively backwardly extended from the contact endpieces 3121 out of a bottom side of the base 31 and electrically bonded to respective solder pads 41 at the circuit board 4.

The electrical connector 3 further comprises two upright posts 32 respectively disposed at two opposite ends of the base 31. Each upright post 32 comprises a receiving space 321 for the positioning of one respective retaining spring plate 26, a bearing groove 3221 defined in the receiving space 321, and two engagement blocks 322 respectively disposed at two opposite sides of the bearing groove 3221.

The two retaining spring plates 26 are respectively disposed at two opposite lateral sides of the rack body 21. Each retaining spring plate 26 comprises a resisting portion 261, an engaging portion 262, and a releasing portion 263. The resisting portion 261 of each retaining spring plate 26 is inserted into the receiving space 321 of one respective upright post 32. The engaging portion 262 of each retaining spring plate 26 is positioned in the bearing groove 3221 of the respective upright post 32 and engaged with the respective engagement blocks 322 of the respective upright post 32.

To insert the edge card 1 into the electrical connector 3, first place the edge card 1 in the rack 2, and then insert the rack 2 into the electrical connector 3. In the assembly process, the edge card 1 and the rack 2 are assembled without using any hand tools, and only the edge card 1 needs to be engaged in the rack 2. Then insert the rack 2 into the electrical connector 3 and do not need to use the hand tool. The installation is done when the two retaining spring plates 26 on the two opposite lateral sides of the rack 2 are respectively inserted into the two upright posts 32 of the electrical connector 3. If it is shaken during manufacturing or transportation, it will not cause separation between the rack 2 and electrical connector 3. By means of the engagement structure between the rack 2 and the electrical connector 3, the edge card 1 can be connected to the electrical connector 3 without using any hand tools.

The two adjustment members 25 each further a finger grip 252 disposed at an outer side. To pull the rack 2 out of the electrical connector 3, the two finger grips 252 act as the fulcrum for the applied force to remove the rack 2 from the electrical connector 3, and two fingers are respectively pressed on the releasing portions 263 of the two retaining spring plates 26 to bias the releasing portions 263 from an inclined position to a vertical position, causing disengagement of the engaging portions 262 of the two retaining spring plates 26 from the engagement blocks 322 of the respective upright posts 32. At this time, the rack 2 can be directly and upwardly removed from the electrical connector 3. After removal of the rack 2 from the electrical connector 3, the edge card 1 can then be removed from the accommodation open chamber 211 of the rack 2.

Figure 4:
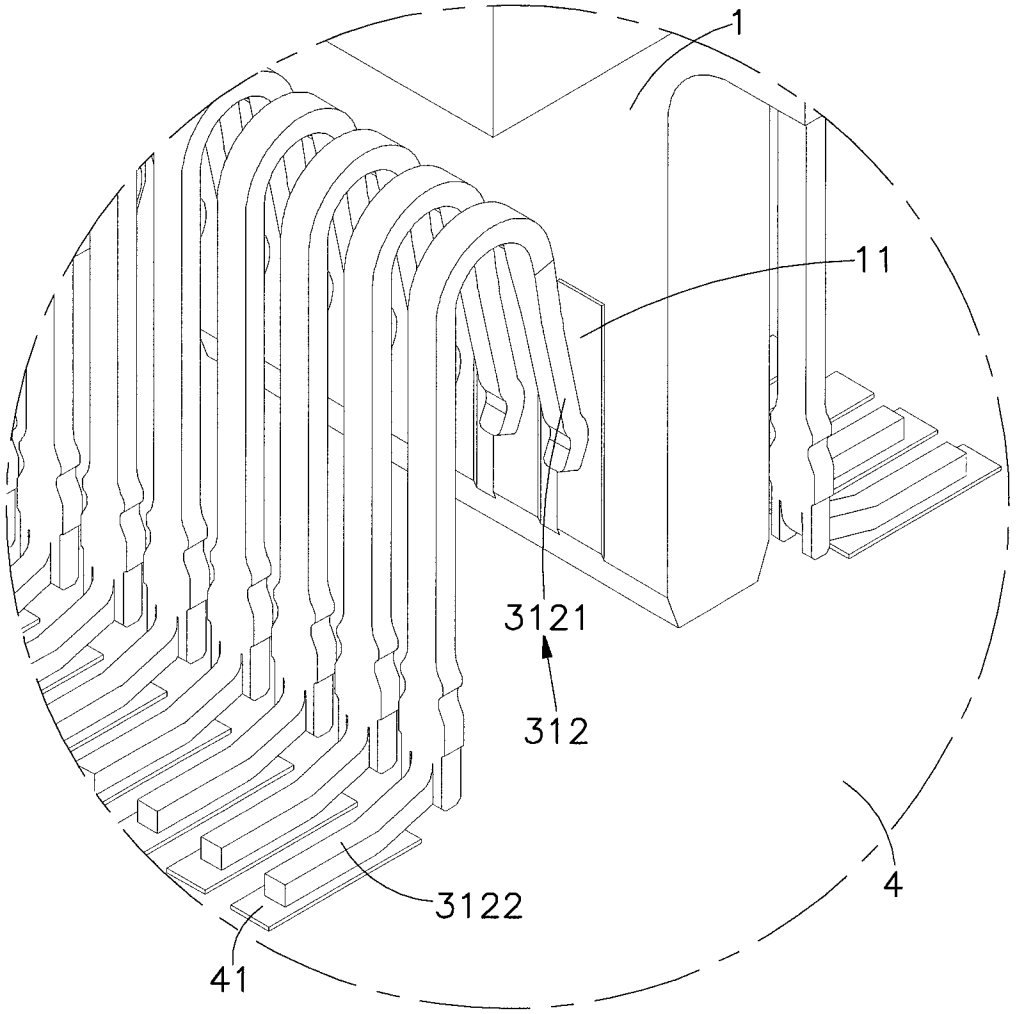
FIG. 4 is an enlarged view of a part of the present invention, illustrating the contacts of the edge card in contact with the respective contact endpieces of the conducting terminal set.

Referring to FIG. 4, when the two adjustment members 25 of the rack 2 are pressed to move the edge card 1 downwardly to the lower limit, the two opposite ends of the bottom side of the edge card 1 are respectively stopped at the two bearing plates 24 of the rack 2. At this time, the electric contacts 11 of the edge card 1 are respectively kept in positive contact with the respective contact endpieces 3121 of the conducting terminal set 312 of the electrical connector 3 without any skew, enhancing high frequency signal transmission stability.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An edge card mounting structure, comprising an edge card, an electrical connector disposed on a circuit board, and a rack adapted for holding said edge card and insertable into said electrical connector to electrically connect said edge card to said electrical connector, wherein said rack comprises:

a rack body comprising an accommodation open chamber adapted for accommodating said edge card;

two stop plates bilaterally and fixedly mounted in said accommodation open chamber for abutment against one surface of said edge card;

two position-limiting blocks bilaterally and fixedly mounted in said accommodation open chamber for abutment against an opposite surface of said edge card, said two position-limiting blocks and said two stop plates defining therebetween an area that sandwiches the two opposite surfaces of said edge card;

two bearing plates bilaterally and fixedly mounted in said accommodation open chamber for abutment against two opposite ends of a bottom side of said edge card; and at least one adjustment member provided at a top side of said rack body, said at least one adjustment member being pressable to move said edge card downwardly in the area in said accommodation chamber between said two position-limiting blocks and said two stop plates into abutment against said bearing plates.

2. The edge card mounting structure as claimed in claim 1, wherein each said adjustment member is composed of a spring plate.

3. The edge card mounting structure as claimed in claim 1, wherein the number of said at least one adjustment member is 2, and the two said adjustment members are symmetrically disposed above said rack body and define with said rack body an adjustment gap therebetween, said adjustment gap being used to provide a space for displacement of said two adjustment members under pressure.

4. The edge card mounting structure as claimed in claim 1, wherein said electrical connector comprises a base, an insertion slot disposed in a top side of said base for the insertion of said edge card and a conducting terminal set mounted in said base, said conducting terminal set comprising a plurality of contact endpieces suspending in said insertion slot for contacting respective electric contacts of said edge card electrically and a plurality of bonding endpieces respectively backwardly extended from said contact endpieces out of a bottom side of said base and electrically bonded to respective solder pads at said circuit board.

5. The edge card mounting structure as claimed in claim 1, wherein said electrical connector comprises a base, an insertion slot disposed in a top side of said base for the insertion of said edge card, a conducting terminal set mounted in said insertion slot for the contact of respective electric contacts of said edge card, and two upright posts respectively disposed at two opposite ends of said base, each said upright post comprising a receiving space; said rack further comprises two retaining spring plates respectively disposed at two opposite lateral sides of said rack body and respectively engaged in said receiving spaces of said two upright posts of said electrical connector.

6. The edge card mounting structure as claimed in claim 1, wherein each upright post further comprises a bearing groove defined in a receiving space and two engagement blocks respectively disposed at two opposite sides of said bearing groove; each retaining spring plate of said rack comprises a resisting portion inserted into said receiving space of one respective said upright post, an engaging portion positioned in said bearing groove of the respective said upright post and engaged with said engagement blocks of the respective said upright post, and a releasing portion for pressing by an external force to release said engaging portion from said engagement blocks of the respective said upright post.

* * * * *